US011926400B1

(12) United States Patent
Zhang et al.

(10) Patent No.: US 11,926,400 B1
(45) Date of Patent: Mar. 12, 2024

(54) BOTTOM TOUCHING ASSISTING DEVICE SUITABLE FOR DEEP-SEA SUBMERSIBLES AND IMPLEMENTATION METHOD THEREOF

(71) Applicant: Qingdao Institute of Marine Geology, Qingdao (CN)

(72) Inventors: Xilin Zhang, Qingdao (CN); Nengyou Wu, Qingdao (CN); Qingsheng Liu, Qingdao (CN); Hong Cao, Qingdao (CN); Ang Li, Qingdao (CN); Zhilei Sun, Qingdao (CN); Cuiling Xu, Qingdao (CN); Ye Chen, Qingdao (CN); Sinan Xu, Qingdao (CN); Jianjun Miao, Qingdao (CN)

(73) Assignee: Qingdao Institute of Marine Geology, Qingdao (CN)

( * ) Notice: Subject to any disclaimer, the term of this patent is extended or adjusted under 35 U.S.C. 154(b) by 0 days.

(21) Appl. No.: 18/530,311

(22) Filed: Dec. 6, 2023

(30) Foreign Application Priority Data

Dec. 12, 2022 (CN) ..... 202211595022.8

(51) Int. Cl.
*B63G 8/00* (2006.01)

(52) U.S. Cl.
CPC ..... *B63G 8/001* (2013.01)

(58) Field of Classification Search
CPC ..... B63G 8/001
See application file for complete search history.

(56) References Cited

U.S. PATENT DOCUMENTS 3,832,965 A * 9/1974 Walker ..... B63G 8/42 114/42
8,677,920 B1 * 3/2014 Jeng ..... B63B 3/08 114/77 R

* cited by examiner

*Primary Examiner* — S. Joseph Morano
*Assistant Examiner* — Jovon E Hayes
(74) *Attorney, Agent, or Firm* — Bayramoglu Law Offices LLC

(57) ABSTRACT

A bottom touching assisting device suitable for deep-sea submersibles and an implementation method thereof are provided. Four support columns are arranged within a mounting box body at a bottom of a deep-sea submersible, the support columns and the mounting box body are connected in a sliding manner through sliders, and the support column is sleeved with a threaded sleeve in a threaded connection manner. In conjunction with a drive component and a pressing mechanism, smooth vertical movement of the support column is achieved when the threaded sleeve rotates. This allows a bottom end of the support column to extend from the mounting box body.

10 Claims, 4 Drawing Sheets

BOTTOM TOUCHING ASSISTING DEVICE SUITABLE FOR DEEP-SEA SUBMERSIBLES AND IMPLEMENTATION METHOD THEREOF

CROSS-REFERENCE TO THE RELATED APPLICATION

This application is based upon and claims priority to Chinese Patent Application No. 202211595022.8 filed on Dec. 12, 2022, the entire content of which is incorporated herein by reference.

TECHNICAL FIELD

The invention belongs to the technical field of marine environment detection and monitoring equipment, and particularly relates to a bottom touching assisting device suitable for deep-sea submersibles and an implementation method thereof.

BACKGROUND

The current exploration of the ocean by humans only covers 5% of the total marine area, especially for deep-sea exploration. Unmanned and manned submersibles are commonly used and effective tools for deep-sea exploration in the current development stage. These deep-sea submersibles are not only used for visual detection near the seabed but also required to sit on the seabed for collecting marine organisms, water, and rock samples. However, the commonly used conventional deep-sea submersibles, such as ROV and HOV, are often unsuitable for bottom sitting operations. They typically rely on propellers and their own buoyancy for hovering and positioning, and use robotic arms or other tools for targeted sampling operations. In extreme environments such as hydrothermal vents, cold seeps, and abyssal areas in the deep sea, continuous and long-duration precise operations are often necessary. However, due to the lack of a direct bottom sitting device, traditional submersibles (such as ROV and HOV) do not have the capability to crawl on the seabed. As a result, they cannot perform long-duration precise ground ecosystem detection tasks in deep-sea hydrothermal vent and cold seep areas. If forced to sit on the seabed, the submersible tends to collide with the seabed, leading to damage.

In response to the issue of collision and the inability to conduct long-duration and continuous precise operations on the seafloor, some scholars at home and abroad have proposed some solutions. There are mainly two ways: (1) directly installing a chassis at the bottom of the submersible; for example, researchers have directly installed detachable track or wheel configurations on the bottom of the submersible to achieve ground crawling and precise positioning for operations; and (2) designing a composite drive configuration (such as quadruped, hexapod, and paddle-body motion mechanisms), which helps to realize ground crawling and long-duration precise operations of deep-sea submersibles in complex seafloor terrains. However, whether it is track-based, wheel-based, or leg-based bottom touching mechanisms, they are all structurally complex, expensive, and prone to malfunctions. In view of the above situation and to overcome the defects of the prior art, the invention provides a bottom touching assisting device suitable for deep-sea submersibles and an implementation method thereof. It effectively addresses the problems in the prior art where deep-sea submersibles come into direct contact with the seafloor during the bottom sitting process, leading to collision and damage, as well as the inability to sit on the seabed to perform long-duration precise operations when the seafloor terrain is uneven.

SUMMARY

To addresses the problems in the prior art where deep-sea submersibles come into direct contact with the seafloor during the bottom sitting process, leading to collision and damage, as well as the inability to sit on the seabed to perform long-duration precise operations when the seafloor terrain is uneven, the invention provides a bottom touching assisting device suitable for deep-sea submersibles and an implementation method thereof.

The invention is realized by the following technical scheme.

A bottom touching assisting device suitable for deep-sea submersibles comprises a deep-sea submersible, wherein a mounting box body is fixedly connected to a bottom of the deep-sea submersible, four support columns are arranged in the mounting box body, and the support columns and the mounting box body are connected in a sliding manner through sliders; the support column is sleeved with a threaded sleeve in a threaded connection manner, the threaded sleeve is sleeved with a first ring gear in a fixed connection manner, and the threaded sleeve penetrates through a bottom inner wall of the mounting box body and is rotatably connected with the mounting box body through a first bearing; one side of the first ring gear is provided with a first gear, the first gear and the mounting box body are connected through a rotating member, and the first gear meshes with the first ring gear; a top of the first gear is provided with a friction wheel, a bottom of the friction wheel is in contact with the top of the first gear, and a prism is fixedly connected to a top of the friction wheel; the prism is sleeved with a second ring gear in a fixed connection manner, one side of the second ring gear is provided with a second gear, and the second gear meshes with the second ring gear; two worms are arranged inside the mounting box body, the worm penetrates through the mounting box body and is rotatably connected with the mounting box body through a second bearing, and the two worms are connected through a synchronous rotator; the second gear and the worm are connected through a transmission unit, and one end of one of the worms is fixedly connected with a third gear located at one side of the mounting box body; and the mounting box body is provided with a rotary drive component matched with the third gear, and the mounting box body is also provided with a pressing mechanism matched with the prism.

Preferably, the transmission unit comprises a first rotating shaft fixedly installed at a top of the second gear, a top end of the first rotating shaft is rotatably connected with the mounting box body through a third bearing, the first rotating shaft is sleeved with a worm wheel in a fixed connection manner, and the worm wheel meshes with the worm.

Preferably, the rotary drive component comprises a motor box arranged at one side of the mounting box body, the motor box is a cavity structure with one side open, the third gear is located in the motor box, a servo motor is fixedly connected in the motor box, a fourth gear is fixedly connected to an output end of the servo motor, and the fourth gear meshes with the third gear.

Preferably, positioning blocks are respectively arranged on two sides of the motor box, the positioning block is sleeved with a positioning ring, the positioning ring is fixedly connected with the motor box, and the positioning block and the mounting box body are fixedly connected; a support plate is fixedly connected to one side of the mounting box body, the support plate is located above the motor box, and a rectangular hole is formed in the support plate; and a baffle is arranged on a side, away from the mounting box body, of the motor box, one side of the baffle is in contact with the motor box, the baffle penetrates through the rectangular hole, and the baffle and the support plate are connected by a snap-fit device.

Preferably, the snap-fit device comprises an insertion hole formed in one side of the baffle, a through hole is formed in an inner wall of one side of the rectangular hole, and a first connecting plate is arranged on a side, away from the mounting box body, of the support plate; an insertion block is fixedly connected to the first connecting plate, the insertion block penetrates through the through hole, and one end of the insertion block is inserted into the insertion hole; one side of the support plate is provided with a first groove, a first movable block is fixedly connected to the first connecting plate, and the first movable block is inserted into the first groove; and one side of the first movable block is connected with an inner wall of the first groove through a first tension spring, a lug is fixedly connected to one side of the baffle, and a bottom of the lug is in contact with a top of the support plate.

Preferably, the synchronous rotator comprises sprockets fixedly sleeved outside the worms, and the two corresponding sprockets are connected through a chain; the rotating member comprises a second rotating shaft fixedly installed at a bottom of the first gear, and a bottom end of the second rotating shaft is rotatably connected with the mounting box body through a fourth bearing; and the slider comprises a first positioning column arranged at one side of the support column, two ends of the first positioning column are fixedly connected with an inner wall of the mounting box body, a second connecting plate is fixedly connected to the support column, and the first positioning column penetrates through the second connecting plate.

Preferably, the pressing mechanism comprises a movable frame arranged in the mounting box body, four support parts are fixedly connected to the movable frame, and the support part is provided with a second groove; a top end of the prism is inserted into the second groove, and the top end of the prism and an inner wall of the second groove are connected by a first compression spring; a screw rod and a second positioning column are arranged in the mounting box body, both the screw rod and the second positioning column penetrate through the movable frame, the screw rod and the movable frame are in threaded connection, and two ends of the second positioning column are fixedly connected with an inner wall of the mounting box body; and a bottom end of the screw rod penetrates through the bottom inner wall of the mounting box body, the screw rod and the mounting box body are rotatably connected through a fifth bearing, and an anti-rotation device matched with the screw rod is arranged on the mounting box body.

Preferably, the anti-rotation device comprises a movable disc arranged at a bottom of the mounting box body, a bottom end of the screw rod is provided with a third groove, and a second movable block is fixedly connected to the movable disc; the second movable block is inserted into the third groove, a top end of the second movable block is connected with an inner wall of the third groove through a second tension spring, and the bottom inner wall of the mounting box body is provided with a plurality of limit holes; and a plurality of limit columns are fixedly connected to the movable disc, the limit columns are inserted into the corresponding limit holes, and a handle is arranged on the movable disc.

Preferably, two sides of the movable disc are respectively provided with sliders, a top of the slider is in contact with a bottom of the mounting box body, a side, away from the mounting box body, of the slider is provided with a spherical groove, and a ball is arranged in the spherical groove; a connecting column is fixedly connected to a side, away from the movable disc, of the slider, the connecting column is sleeved with a fixed plate and a second compression spring, the fixed plate is fixedly connected with the mounting box body, and two ends of the second compression spring respectively abut against the slider and the fixed plate; and the slider is in contact with the movable disc, and a fixed disc is fixedly connected to an end, away from the slider, of the connecting column.

The invention further provides a bottom touching assisting method suitable for deep-sea submersibles, which involves the bottom touching assisting device suitable for deep-sea submersibles as described above. The method comprises the following steps:

Step 1, when the deep-sea submersible moves to the seabed, the rotary drive component drives the third gear to rotate, and the third gear drives one of the worms to rotate; through the design of the synchronous rotator, when one worm rotates, the other worm rotates synchronously, and when the third gear drives one of the worms to rotate, the two worms rotate synchronously;

Step 2, when the worm rotates, the worm drives the worm wheel to rotate, so as to rotate the first rotating shaft and the second gear, and the second gear drives the second ring gear to rotate;

Step 3, the prism and the second ring gear are pressed through the pressing mechanism, so as to make the friction wheel cling to a top of the first gear; when the second ring gear rotates, the prism drives the friction wheel to rotate, the friction wheel drives the first gear to rotate, and through the cooperation of the first gear and the first ring gear, the threaded sleeve rotates synchronously;

Step 4, because the threaded sleeve and the support column are in threaded connection, when the threaded sleeve rotates, the support column moves in the vertical direction, so that a bottom end of the support column protrudes from the mounting box body;

Step 5, when the seabed has a flat surface, the bottom ends of the four support columns make contact with the seabed at the same time; when the seabed has an uneven surface, the bottom ends of some of the support columns first come into contact with the seabed, these support columns stop moving downwards, and the rotation of the threaded sleeve is resisted, so that the first ring gear and the first gear stop rotating, and the friction wheel rotates relative to the first gear; and Step 6, the rest of the support columns which are not in contact with the seabed continue to move downwards until the bottom ends of all the support columns are in contact with the seabed; depending on the smoothness of the seabed, each support column extends to a different length from the mounting box body, making the deep-sea submersible rest level on the seafloor, increasing its stability, and allowing the deep-sea submersible to park at the bottom of the sea.

Compared with the prior art, the invention has the following advantages and beneficial effects.

According to the invention, the four support columns are arranged within the mounting box body at the bottom of the deep-sea submersible, the support columns and the mounting box body are connected in a sliding manner through the sliders, and the support column is sleeved with the threaded sleeve in a threaded connection manner. In conjunction with the drive component and the pressing mechanism, smooth vertical movement of the support column is achieved when the threaded sleeve rotates. This allows the bottom end of the support column to extend from the mounting box body. Depending on the smoothness of the seabed, each support column extends to a different length from the mounting box body, ensuring stable placement of the deep-sea submersible on the seafloor, increasing its stability, and allowing the deep-sea submersible to park at the bottom of the sea. Moreover, because the deep-sea submersible is not in direct contact with the seabed, the possibility of direct collision with the seabed which may lead to damage of the submersible is reduced.

Additionally, the design of the positioning blocks and the positioning rings avoids the vertical movement of the motor box, allowing the motor box and the servo motor to be securely fixed relative to the mounting box body. Furthermore, the structural design of the drive component and the snap-fit device enables convenient disassembly and installation of the motor box and the servo motor.

Figure 1:
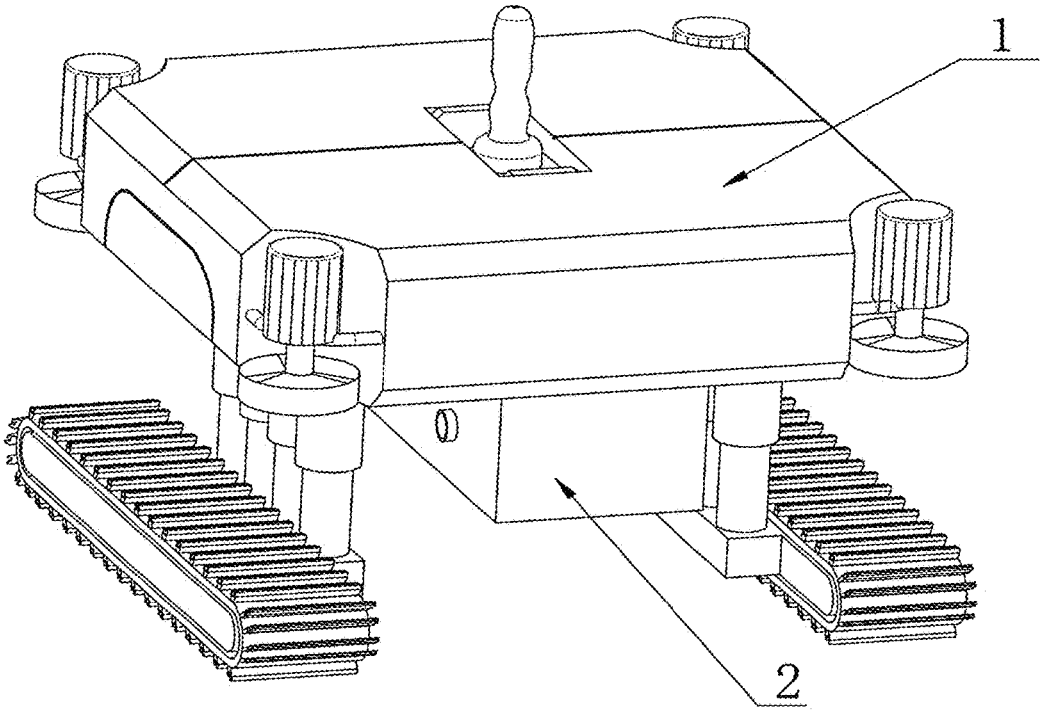
FIG. 1 is a diagram of an overall structure of a bottom touching assisting device according to an embodiment of the invention.

Included in the drawings are: 1. deep-sea submersible; 2. mounting box body; 3. support column; 4. threaded sleeve; 5. first bearing; 6. first ring gear; 7. first gear; 8. friction wheel; 9. prism; 10. second ring gear; 11. second gear; 12. worm; 13. worm wheel; 14. first rotating shaft; 15. second bearing; 16. third bearing; 17. third gear; 18. motor box; 19. servo motor; 20. fourth gear; 21. support plate; 22. positioning block; 23. positioning ring; 24. rectangular hole; 25. baffle; 26. through hole; 27. insertion hole; 28. insertion block; 29. first connecting plate; 30. first groove; 31. first movable block; 32. first tension spring; 33. lug; 34. sprocket; 35. chain; 36. second rotating shaft; 37. fourth bearing; 38. first positioning column; 39. second connecting plate; 40. movable frame; 41. support part; 42. second groove; 43. first compression spring; 44. screw rod; 45. second positioning column; 46. fifth bearing; 47. movable disc; 48. third groove; 49. second movable block; 50. second tension spring; 51. limit hole; 52. limit column; 53. handle; 54. slider; 55. spherical groove; 56. ball; 57. fixed plate; 58. connecting column; 59. second compression spring; 60. fixed disc.

DETAILED DESCRIPTION OF THE EMBODIMENTS

In order to better understand the above objects, features and advantages of the invention, the invention will be further described with reference to the attached drawings and embodiments. In the following description, many specific details are set forth in order to fully understand the invention. However, the invention may be practiced in other ways than those described herein, and therefore, the invention is not limited to the specific embodiments disclosed below.

In Embodiment 1, a bottom touching assisting device suitable for deep-sea submersibles, as shown in FIGS. 1-8, comprises a mounting box body 2 fixedly connected to a bottom of a deep-sea submersible 1, four support columns 3 are arranged in the mounting box body 2, and the support columns 3 and the mounting box body 2 are connected in a sliding manner through sliders; the support column 3 is sleeved with a threaded sleeve 4 in a threaded connection manner, the threaded sleeve 4 is sleeved with a first ring gear 6 in a fixed connection manner, and the threaded sleeve 4 penetrates through a bottom inner wall of the mounting box body 2 and is rotatably connected with the mounting box body 2 through a first bearing 5; one side of the first ring gear 6 is provided with a first gear 7, the first gear 7 and the mounting box body 2 are connected through a rotating member, and the first gear 7 meshes with the first ring gear 6; a top of the first gear 7 is provided with a friction wheel 8, a bottom of the friction wheel 8 is in contact with the top of the first gear 7, and a prism 9 is fixedly connected to a top of the friction wheel 8; the prism 9 is sleeved with a second ring gear 10 in a fixed connection manner, one side of the second ring gear 10 is provided with a second gear 11, and the second gear 11 meshes with the second ring gear 10; additionally, two worms 12 are arranged inside the mounting box body 2, the worm 12 penetrates through the mounting box body 2 and is rotatably connected with the mounting box body 2 through a second bearing 15, and the two worms 12 are connected through a synchronous rotator; the second gear 11 and the worm 12 are connected through a transmission unit, and one end of one of the worms 12 is fixedly connected with a third gear 17 located at one side of the mounting box body 2; and the mounting box body 2 is provided with a rotary drive component matched with the third gear 17, and the mounting box body 2 is also provided with a pressing mechanism matched with the prism 9.

Figure 2:
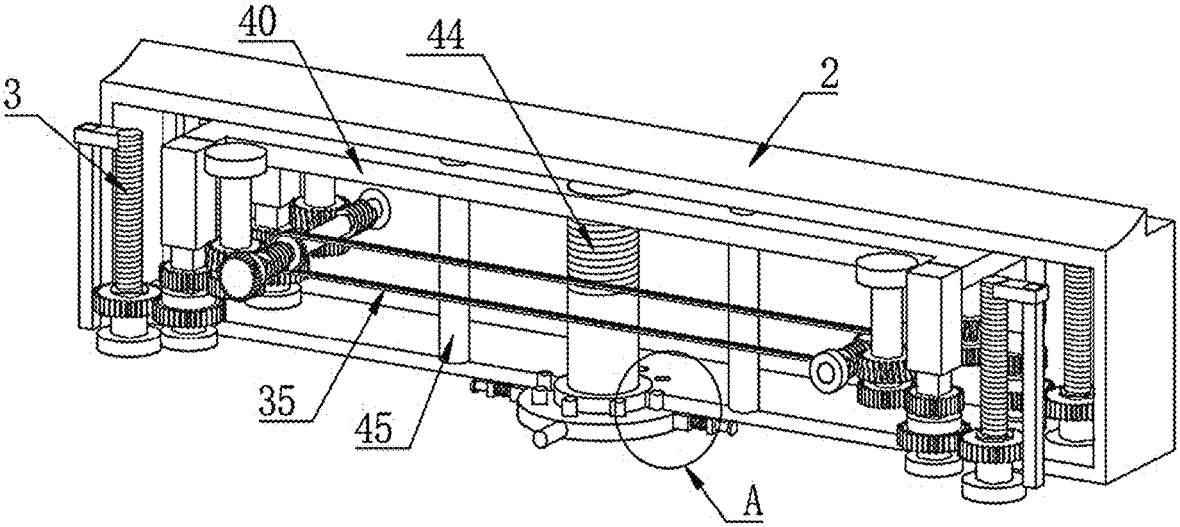
FIG. 2 is a structural diagram of the interior of a mounting box body according to an embodiment of the invention.
Figure 3:
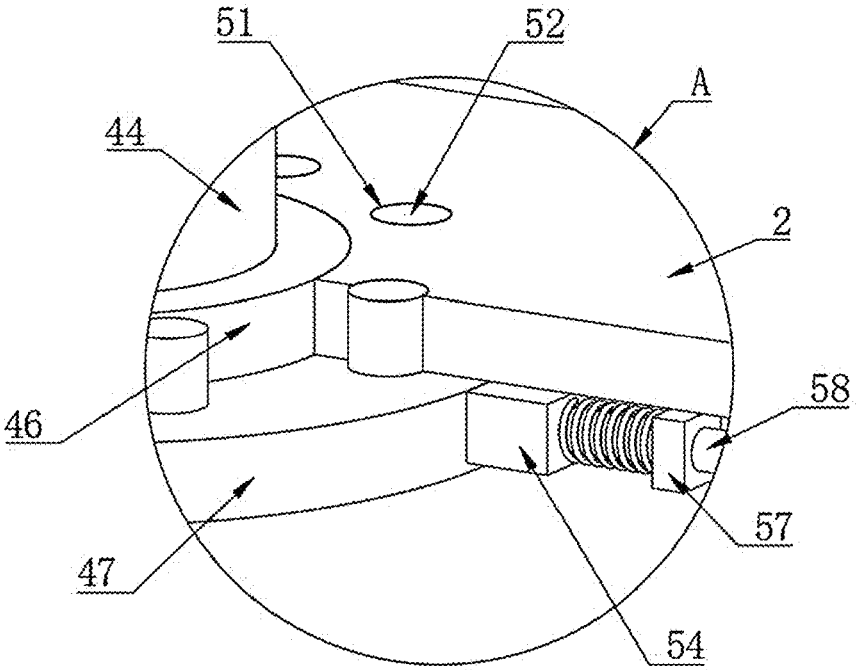
FIG. 3 is a partially enlarged view of part A in FIG. 2.
Figure 4:
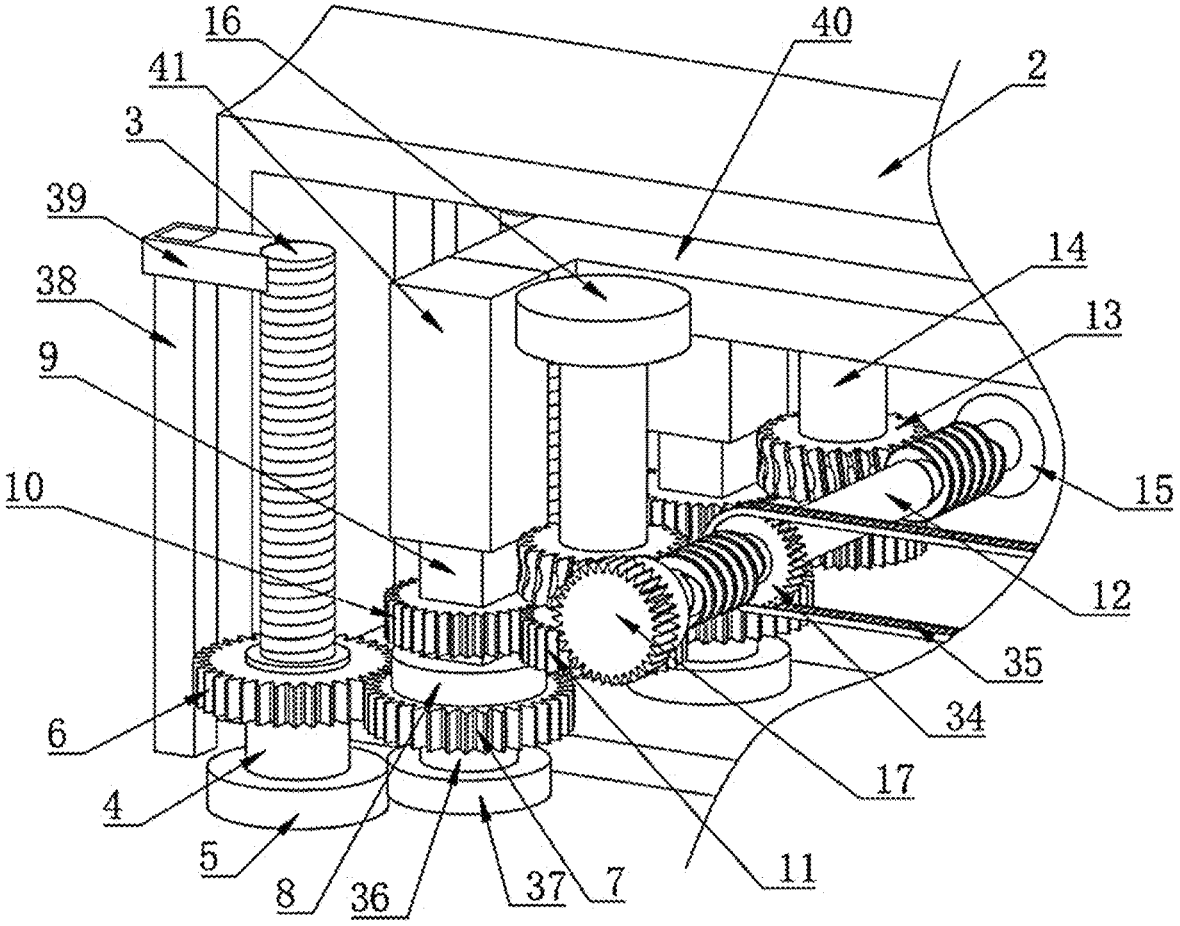
FIG. 4 is a structural diagram of a rotating member according to an embodiment of the invention.
Figure 5:
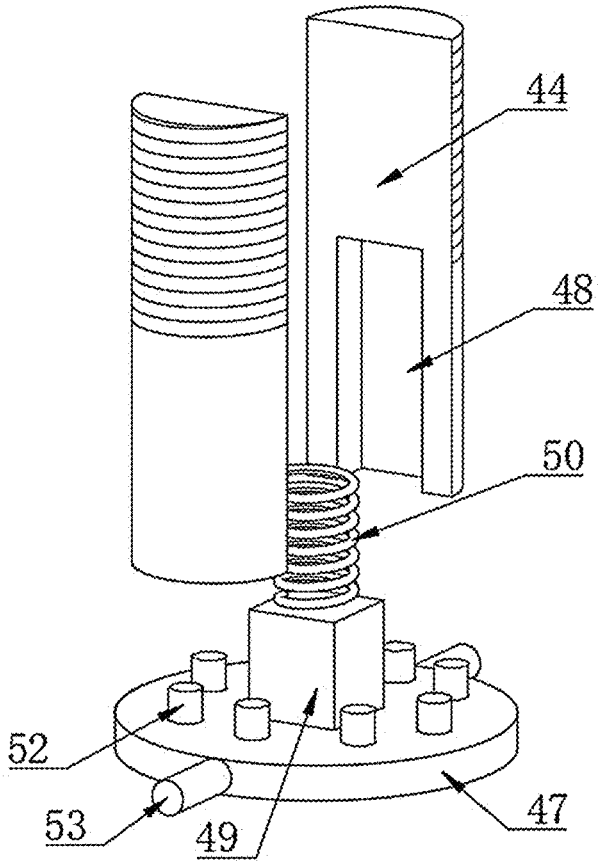
FIG. 5 is a section view of a screw rod according to an embodiment of the invention.
Figure 6:
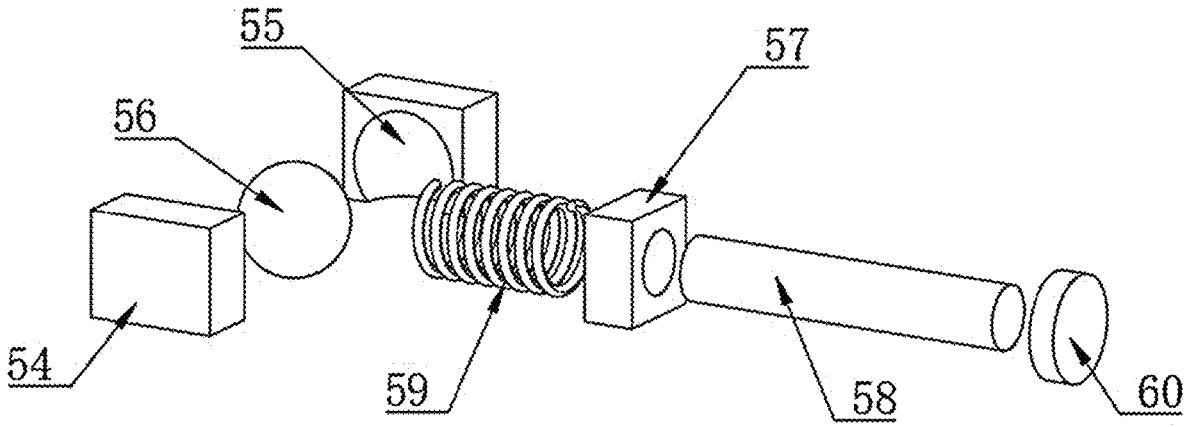
FIG. 6 is a section view of a slider according to an embodiment of the invention.
Figure 7:
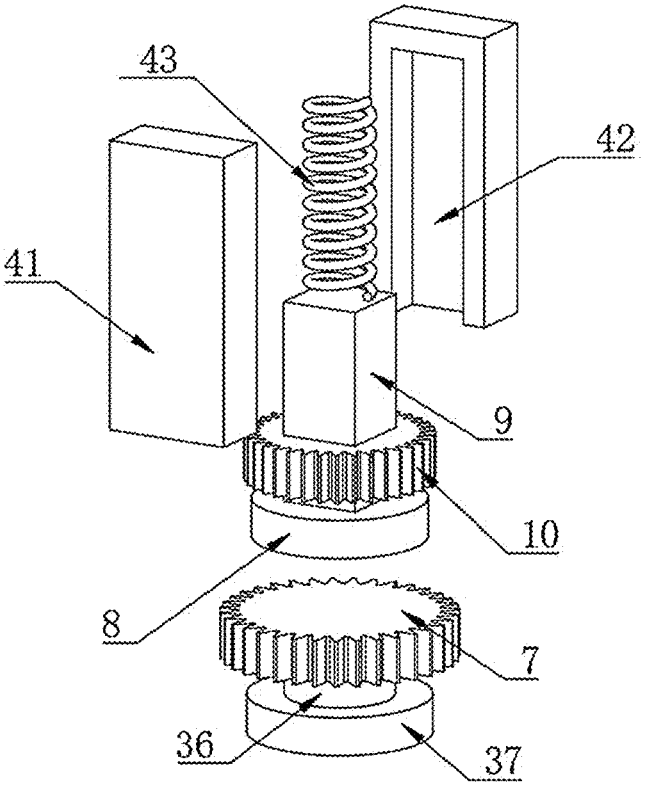
FIG. 7 is a section view of a support part according to an embodiment of the invention.

The transmission unit comprises a first rotating shaft 14 fixedly installed at a top of the second gear 11, as shown in FIGS. 2 and 4, a top end of the first rotating shaft 14 is rotatably connected with the mounting box body 2 through a third bearing 16, the first rotating shaft 14 is sleeved with a worm wheel 13 in a fixed connection manner, and the worm wheel 13 meshes with the worm 12; the synchronous rotator comprises sprockets 34 fixedly sleeved outside the worms 12, and the two corresponding sprockets 34 are connected through a chain 35; the rotating member comprises a second rotating shaft 36 fixedly installed at a bottom of the first gear 7, and a bottom end of the second rotating shaft 36 is rotatably connected with the mounting box body 2 through a fourth bearing 37; and the slider comprises a first positioning column 38 arranged at one side of the support column 3, two ends of the first positioning column 38 are fixedly connected with an inner wall of the mounting box body 2, a second connecting plate 39 is fixedly connected to the support column 3, the first positioning column 38 penetrates through the second connecting plate 39, and the first positioning column 38 is parallel to the support column 3.

In specific operation, the deep-sea submersible 1 moves to the seabed, the rotary drive component drives the third gear 17 to rotate, and the third gear 17 drives one of the worms 12 to rotate; through the design of the synchronous rotator, when one worm 12 rotates, the other worm 12 rotates synchronously, and when the third gear 17 drives one of the worms 12 to rotate, the two worms 12 rotate synchronously; the worm 12 drives the worm wheel 13 to rotate, so as to rotate the first rotating shaft 14 and the second gear 11, and the second gear 11 drives the second ring gear 10 to rotate; the prism 9 and the second ring gear 10 are pressed through the pressing mechanism, so as to make the friction wheel 8 cling to a top of the first gear 7; when the second ring gear 10 rotates, the prism 9 drives the friction wheel 8 to rotate, the friction wheel 8 drives the first gear 7 to rotate, and through the cooperation of the first gear 7 and the first ring gear 6, the threaded sleeve 4 rotates synchronously; because the threaded sleeve 4 and the support column 3 are in threaded connection, when the threaded sleeve 4 rotates, the support column 3 moves in the vertical direction, so that a bottom end of the support column 3 protrudes from the mounting box body 2; in a case where the seabed has a flat surface, the bottom ends of the four support columns 3 make contact with the seabed at the same time; in a case where the seabed has an uneven surface, the bottom ends of some of the support columns 3 first come into contact with the seabed, these support columns 3 stop moving downwards, and the rotation of the threaded sleeve 4 is resisted, so that the first ring gear 6 and the first gear 7 stop rotating, and the friction wheel 8 rotates relative to the first gear 7; and the rest of the support columns 3 which are not in contact with the seabed continue to move downwards until the bottom ends of all the support columns 3 are in contact with the seabed; depending on the smoothness of the seabed, each support column 3 extends to a different length from the mounting box body 2, making the deep-sea submersible 1 rest level on the seafloor, increasing its stability, and allowing the deep-sea submersible 1 to park at the bottom of the sea. Moreover, the deep-sea submersible 1 is not in direct contact with the seabed, reducing the possibility of collision damage to the deep-sea submersible 1. Through the design of the sprocket 34 and the chain 35, when one worm 12 and one sprocket 34 rotate, the chain 35 drives the other sprocket 34 and the other worm 12 to rotate. Through the design of the second rotating shaft 36 and the fourth bearing 37, the first gear 7 is rotatably connected with the mounting box body 2. Through the design of the first positioning column 38 and the second connecting plate 39, the support column 3 moves smoothly in the vertical direction.

Figure 8:
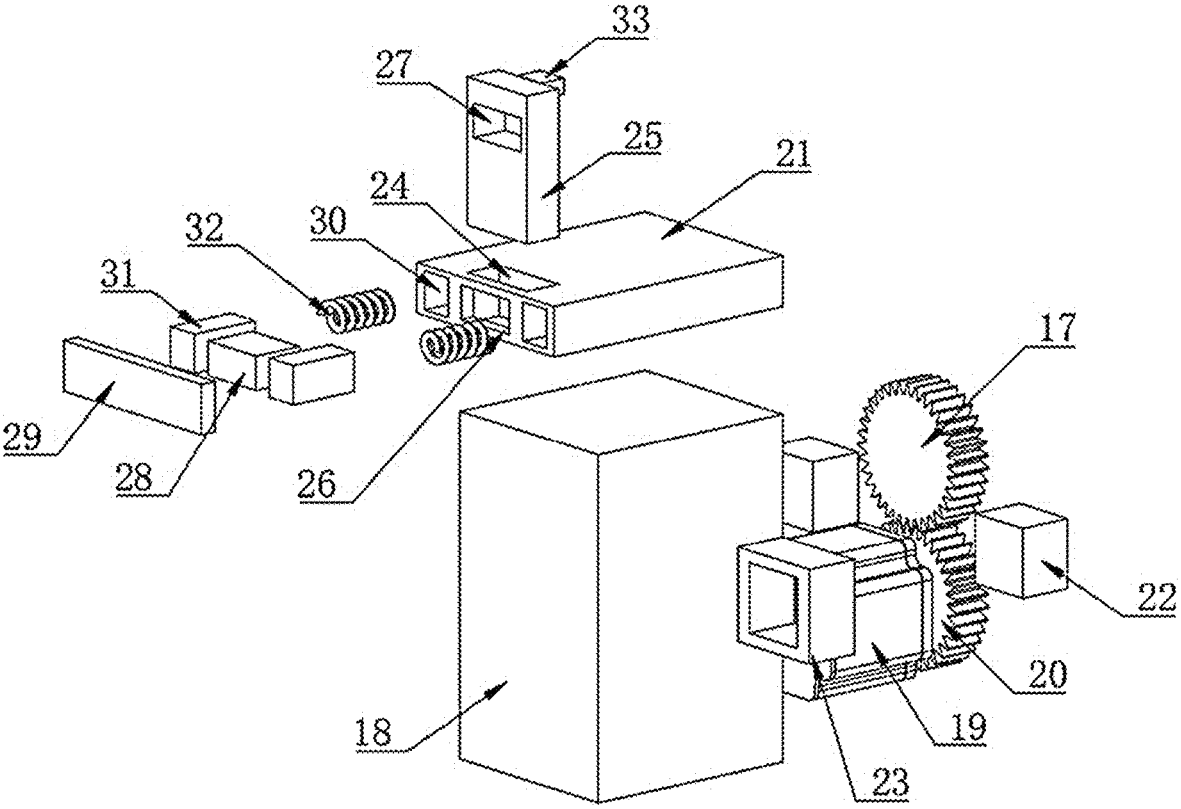
FIG. 8 is an exploded view of a snap-fit device according to an embodiment of the invention.

Referring to FIGS. 1, 4 and 8, the rotary drive component comprises a motor box 18 arranged at one side of the mounting box body 2, the motor box 18 is a cavity structure with one side open, the third gear 17 is located in the motor box 18, a servo motor 19 is fixedly connected in the motor box 18, a fourth gear 20 is fixedly connected to an output end of the servo motor 19, and the fourth gear 20 meshes with the third gear 17. Positioning blocks 22 are respectively arranged on two sides of the motor box 18, the positioning block 22 is sleeved with a positioning ring 23, the positioning ring 23 is fixedly connected with the motor box 18, and the positioning block 22 and the mounting box body 2 are fixedly connected; a support plate 21 is fixedly connected to one side of the mounting box body 2, the support plate 21 is located above the motor box 18, and a rectangular hole 24 is formed in the support plate 21; and a baffle 25 is arranged on a side, away from the mounting box body 2, of the motor box 18, one side of the baffle 25 is in contact with the motor box 18, the baffle 25 penetrates through the rectangular hole 24, and the baffle 25 and the support plate 21 are connected by a snap-fit device. The snap-fit device comprises an insertion hole 27 formed in one side of the baffle 25, a through hole 26 is formed in an inner wall of one side of the rectangular hole 24, and a first connecting plate 29 is arranged on a side, away from the mounting box body 2, of the support plate 21; an insertion block 28 is fixedly connected to the first connecting plate 29, the insertion block 28 penetrates through the through hole 26, and one end of the insertion block 28 is inserted into the insertion hole 27; one side of the support plate 21 is provided with a first groove 30, a first movable block 31 is fixedly connected to the first connecting plate 29, and the first movable block 31 is inserted into the first groove 30; and one side of the first movable block 31 is connected with an inner wall of the first groove 30 through a first tension spring 32, a lug 33 is fixedly connected to one side of the baffle 25, and a bottom of the lug 33 is in contact with a top of the support plate 21.

In this embodiment, the servo motor 19 drives the fourth gear 20 to rotate, and the worm 12 is rotated through the cooperation of the fourth gear 20 and the third gear 17. The positioning block 22 and the positioning ring 23 are designed to prevent the motor box 18 from shaking vertically. The baffle 25 is located on a side, away from the mounting box body 2, of the motor box 18, and the position of the motor box 18 is limited by the baffle 25 to prevent the motor box 18 from moving away from the mounting box body 2. Further, the positioning ring 23 is prevented from being separated from the positioning block 22, so that the motor box 18 and the servo motor 19 are fixed relative to the mounting box body 2. When the servo motor 19 needs to be dismantled, the first connecting plate 29 is manually driven to move away from the support plate 21, the first movable block 31 and the insertion block 28 move, the first tension spring 32 is in a tension state, the insertion block 28 is separated from the insertion hole 27, the restriction on the position of the baffle 25 is released, and the baffle 25 is manually driven to move up; in this way, the baffle 25 is no longer in contact with one side of the motor box 18, the position limitation of the motor box 18 is released, the motor box 18 is manually driven to move away from the mounting box body 2, the positioning block 22 is disengaged from the positioning ring 23, and the fourth gear 20 and the third gear 17 are disengaged, thus completing the removal of the motor box 18 and the servo motor 19. When the motor box 18 and the servo motor 19 need to be installed, the motor box 18 and the servo motor 19 are manually driven to move towards the mounting box body 2, the positioning block 22 is inserted into the positioning ring 23, the fourth gear 20 meshes with the third gear 17, and the baffle 25 is manually driven to move down, so that the baffle 25 moves to the side, away from the mounting box body 2, of the motor box 18; and the first connecting plate 29 is released, the first tension spring 32 drives the first movable block 31 and the first connecting plate 29 to move, so that one end of the insertion block 28 is inserted into the insertion hole 27, and the baffle 25 is fixed relative to the support plate 21, completing the installation of the motor box 18 and the servo motor 19.

The pressing mechanism comprises a movable frame 40 arranged in the mounting box body 2, as shown in FIGS. 2, 3, 5, 6 and 7, four support parts 41 are fixedly connected to the movable frame 40, and the support part 41 is provided with a second groove 42; a top end of the prism 9 is inserted into the second groove 42, and the top end of the prism 9 and an inner wall of the second groove 42 are connected by a first compression spring 43; a screw rod 44 and a second positioning column 45 are arranged in the mounting box body 2, both the screw rod 44 and the second positioning column 45 penetrate through the movable frame 40, the screw rod 44 and the movable frame 40 are in threaded connection, and two ends of the second positioning column 45 are fixedly connected with an inner wall of the mounting box body 2; and a bottom end of the screw rod 44 penetrates through the bottom inner wall of the mounting box body 2, the screw rod 44 and the mounting box body 2 are rotatably connected through a fifth bearing 46, and an anti-rotation device matched with the screw rod 44 is arranged on the mounting box body 2. The anti-rotation device comprises a movable disc 47 arranged at a bottom of the mounting box body 2, a bottom end of the screw rod 44 is provided with a third groove 48, and a second movable block 49 is fixedly connected to the movable disc 47; the second movable block 49 is inserted into the third groove 48, a top end of the second movable block 49 is connected with an inner wall of the third groove 48 through a second tension spring 50, and the bottom inner wall of the mounting box body 2 is provided with a plurality of limit holes 51; and a plurality of limit columns 52 are fixedly connected to the movable disc 47, the limit columns 52 are inserted into the corresponding limit holes 51, and a handle 53 is arranged on the movable disc 47. Two sides of the movable disc 47 are respectively provided with sliders 54, a top of the slider 54 is in contact with a bottom of the mounting box body 2, a side, away from the mounting box body 2, of the slider 54 is provided with a spherical groove 55, and a ball 56 is arranged in the spherical groove 55; a connecting column 58 is fixedly connected to a side, away from the movable disc 47, of the slider 54, the connecting column 58 is sleeved with a fixed plate 57 and a second compression spring 59, the fixed plate 57 is fixedly connected with the mounting box body 2, and two ends of the second compression spring 59 respectively abut against the slider 54 and the fixed plate 57; and the slider 54 is in contact with the movable disc 47, and a fixed disc 60 is fixedly connected to an end, away from the slider 54, of the connecting column 58.

When the deep-sea submersible 1 is not submerged, the movable disc 47 is manually driven to move down, so that the second movable block 49 and the limit column 52 move down, the second tension spring 50 is in a tension state, and the limit column 52 is separated from the limiting hole 51, thus releasing the position limitation of the movable disc 47 and the screw rod 44. With the downward movement of the movable disc 47, when the slider 54 is no longer in contact with the side wall of the movable disc 47, the second compression spring 59 drives the slider 54 to move towards the second movable block 49, so that the slider 54 moves between the movable disc 47 and the mounting box body 2, and the ball 56 makes contact with the top of the movable disc 47. At this point, it is not necessary to manually pull down the movable disc 47, the limit column 52 remains out of the limiting hole 51, and the movable disc 47 is manually driven to rotate, so that the second movable block 49 drives the screw rod 44 to rotate; and the movable frame 40 is driven to move vertically by the screw rod 44 to change the height of the support part 41, the length of the prism 9 in the second groove 42 is changed, so that the compression length of the first compression spring 43 is changed, and the force of the first compression spring 43 pressing the prism 9 and the friction wheel 8 is adjusted, so that the friction force between the first gear 7 and the friction wheel 8 can be adjusted. After the adjustment, the fixed disc 60 is manually driven to move away from the fixed plate 57, so that the connecting column 58 drives the slider 54 to move away from the second movable block 49. When the slider 54 is no longer located between the movable disc 47 and the mounting box body 2, the ball 56 is no longer in contact with the top of the movable disc 47, thus releasing the restriction on the position of the movable disc 47. The second extension spring 50 drives the second movable block 49 and the movable disc 47 to move upward, so that the position of the movable disc 47 can be limited by inserting the limit column 52 into the corresponding limit hole 51, and the movable disc 47 and the screw rod 44 can be prevented from rotating and shaking due to non-human factors.

In Embodiment 2, based on the bottom touching assisting device suitable for deep-sea submersibles in Embodiment 1, the invention proposes a bottom touching assisting method suitable for deep-sea submersibles, comprising the following steps:

Step 1, the deep-sea submersible 1 moves to the seabed, the rotary drive component drives the third gear 17 to rotate, and the third gear 17 drives one of the worms 12 to rotate; through the design of the synchronous rotator, when one worm 12 rotates, the other worm 12 rotates synchronously, and when the third gear 17 drives one of the worms 12 to rotate, the two worms 12 rotate synchronously;

Step 2, when the worm 12 rotates, the worm 12 drives the worm wheel 13 to rotate, so as to rotate the first rotating shaft 14 and the second gear 11, and the second gear 11 drives the second ring gear 10 to rotate;

Step 3, the prism 9 and the second ring gear 10 are pressed through the pressing mechanism, so as to make the friction wheel 8 cling to a top of the first gear 7; when the second ring gear 10 rotates, the prism 9 drives the friction wheel 8 to rotate, the friction wheel 8 drives the first gear 7 to rotate, and through the cooperation of the first gear 7 and the first ring gear 6, the threaded sleeve 4 rotates synchronously;

Step 4, because the threaded sleeve 4 and the support column 3 are in threaded connection, when the threaded sleeve 4 rotates, the support column 3 moves in the vertical direction, so that a bottom end of the support column 3 protrudes from the mounting box body 2;

Step 5, in a case where the seabed has a flat surface, the bottom ends of the four support columns 3 make contact with the seabed at the same time; in a case where the seabed has an uneven surface, the bottom ends of some of the support columns 3 first come into contact with the seabed, these support columns 3 stop moving downwards, and the rotation of the threaded sleeve 4 is resisted, so that the first ring gear 6 and the first gear 7 stop rotating, and the friction wheel 8 rotates relative to the first gear 7; and Step 6, the rest of the support columns 3 which are not in contact with the seabed continue to move downwards until the bottom ends of all the support columns 3 are in contact with the seabed; depending on the smoothness of the seabed, each support column 3 extends to a different length from the mounting box body 2, making the deep-sea submersible 1 rest level on the seafloor, increasing its stability, and allowing the deep-sea submersible 1 to park at the bottom of the sea.

The above are only preferred embodiments of the invention, and not intended to limit the invention in other forms.

Any person skilled in the art may use the technical content disclosed above to change or modify it into equivalent embodiments for other fields, but any simple modification, equivalent change and modification of the above embodiments according to the technical essence of the invention without departing from the technical scheme of the invention still belongs to the protection scope of the technical scheme of the invention.

What is claimed is:

1. A bottom touching assisting device suitable for deep-sea submersibles, comprising a deep-sea submersible, wherein a mounting box body is fixedly connected to a bottom of the deep-sea submersible, four support columns are arranged in the mounting box body, and the support columns and the mounting box body are connected in a sliding manner through sliders;

the support column is sleeved with a threaded sleeve in a threaded connection manner, the threaded sleeve is sleeved with a first ring gear in a fixed connection manner, and the threaded sleeve penetrates through a bottom inner wall of the mounting box body and is rotatably connected with the mounting box body;

one side of the first ring gear is provided with a first gear in a meshing manner, and the first gear and the mounting box body are connected through a rotating member;

a top of the first gear is provided with a friction wheel, a bottom of the friction wheel is in contact with the top of the first gear, and a prism is fixedly connected to a top of the friction wheel;

the prism is sleeved with a second ring gear in a fixed connection manner, and one side of the second ring gear is provided with a second gear in a meshing manner;

two worms are arranged inside the mounting box body, the worm penetrates through the mounting box body and is rotatably connected with the mounting box body, and the two worms are connected through a synchronous rotator;

the second gear and the worm are connected through a transmission unit, and one end of one of the worms is fixedly connected with a third gear located at one side of the mounting box body; and the mounting box body is provided with a rotary drive component matched with the third gear, and the mounting box body is also provided with a pressing mechanism matched with the prism.

2. The bottom touching assisting device suitable for the deep-sea submersibles according to claim 1, wherein the transmission unit comprises a first rotating shaft fixedly installed at a top of the second gear, a top end of the first rotating shaft is rotatably connected with the mounting box body through a third bearing, the first rotating shaft is sleeved with a worm wheel in a fixed connection manner, and the worm wheel meshes with the worm.

3. The bottom touching assisting device suitable for the deep-sea submersibles according to claim 1, wherein the synchronous rotator comprises sprockets fixedly sleeved outside the worms, and the two corresponding sprockets are connected through a chain;

the rotating member comprises a second rotating shaft fixedly installed at a bottom of the first gear, and a bottom end of the second rotating shaft is rotatably connected with the mounting box body through a fourth bearing; and the slider comprises a first positioning column arranged at one side of the support column, two ends of the first positioning column are fixedly connected with an inner wall of the mounting box body, a second connecting plate is fixedly connected to the support column, the first positioning column penetrates through the second connecting plate, and the first positioning column is parallel to the support column.

4. The bottom touching assisting device suitable for the deep-sea submersibles according to claim 1, wherein the rotary drive component comprises a motor box arranged at one side of the mounting box body, the motor box is a cavity structure with one side open, the third gear is located in the motor box, a servo motor is fixedly connected in the motor box, and a fourth gear meshing with the third gear is fixedly connected to an output end of the servo motor.

5. The bottom touching assisting device suitable for the deep-sea submersibles according to claim 4, wherein positioning blocks are respectively arranged on two sides of the motor box, the positioning block is sleeved with a positioning ring, the positioning ring is fixedly connected with the motor box, and the positioning block and the mounting box body are fixedly connected;

a support plate is fixedly connected to one side of the mounting box body, the support plate is located above the motor box, and a rectangular hole is formed in the support plate; and a baffle is arranged on a side, away from the mounting box body, of the motor box, one side of the baffle is in contact with the motor box, the baffle penetrates through the rectangular hole, and the baffle and the support plate are connected by a snap-fit device.

6. The bottom touching assisting device suitable for the deep-sea submersibles according to claim 5, wherein the snap-fit device comprises an insertion hole formed in one side of the baffle, a through hole is formed in an inner wall of one side of the rectangular hole, and a first connecting plate is arranged on a side, away from the mounting box body, of the support plate;

an insertion block is fixedly connected to the first connecting plate, the insertion block penetrates through the through hole, and one end of the insertion block is inserted into the insertion hole;

one side of the support plate is provided with a first groove, a first movable block is fixedly connected to the first connecting plate, and the first movable block is inserted into the first groove; and one side of the first movable block is connected with an inner wall of the first groove through a first tension spring, a lug is fixedly connected to one side of the baffle, and a bottom of the lug is in contact with a top of the support plate.

7. The bottom touching assisting device suitable for the deep-sea submersibles according to claim 1, wherein the pressing mechanism comprises a movable frame arranged in the mounting box body, four support parts are fixedly connected to the movable frame, and the support part is provided with a second groove;

a top end of the prism is inserted into the second groove, and the top end of the prism and an inner wall of the second groove are connected by a first compression spring;

a screw rod and a second positioning column are arranged in the mounting box body, both the screw rod and the second positioning column penetrate through the movable frame, the screw rod and the movable frame are in threaded connection, and two ends of the second positioning column are fixedly connected with an inner wall of the mounting box body; and a bottom end of the screw rod penetrates through the bottom inner wall of the mounting box body, the screw rod and the mounting box body are rotatably connected through a fifth bearing, and an anti-rotation device matched with the screw rod is arranged on the mounting box body.

8. The bottom touching assisting device suitable for the deep-sea submersibles according to claim 7, wherein the anti-rotation device comprises a movable disc arranged at a bottom of the mounting box body, a bottom end of the screw rod is provided with a third groove, and a second movable block is fixedly connected to the movable disc;

the second movable block is inserted into the third groove, a top end of the second movable block is connected with an inner wall of the third groove through a second tension spring, and the bottom inner wall of the mounting box body is provided with a plurality of limit holes; and a plurality of limit columns are fixedly connected to the movable disc, the limit columns are inserted into the corresponding limit holes, and a handle is arranged on the movable disc.

9. The bottom touching assisting device suitable for the deep-sea submersibles according to claim 8, wherein two sides of the movable disc are respectively provided with sliders, a top of the slider is in contact with a bottom of the mounting box body, a side, away from the mounting box body, of the slider is provided with a spherical groove, and a ball is arranged in the spherical groove;

a connecting column is fixedly connected to a side, away from the movable disc, of the slider, the connecting column is sleeved with a fixed plate and a second compression spring, the fixed plate is fixedly connected with the mounting box body, and two ends of the second compression spring respectively abut against the slider and the fixed plate; and the slider is in contact with the movable disc, and a fixed disc is fixedly connected to an end, away from the slider, of the connecting column.

10. An implementation method of the bottom touching assisting device suitable for the deep-sea submersibles according to claim 2, comprising the following steps:

step 1, when the deep-sea submersible moves to seabed, the rotary drive component drives the third gear to rotate, the third gear drives one of the worms to rotate, and the other worm rotates synchronously under drive of the synchronous rotator;

step 2, when the worm rotates, the worm drives the worm wheel to rotate, so as to rotate the first rotating shaft and the second gear, and further drive the second ring gear to rotate;

step 3, the prism and the second ring gear are pressed through the pressing mechanism, so as to make the friction wheel cling to a top of the first gear; when the second ring gear rotates, the prism drives the friction wheel to rotate, the friction wheel drives the first gear to rotate, and through cooperation of the first gear and the first ring gear, the threaded sleeve rotates synchronously;

step 4, because the threaded sleeve and the support column are in threaded connection, when the threaded sleeve rotates, the support column moves in the vertical direction, so that a bottom end of the support column protrudes from the mounting box body;

step 5, when the seabed has a flat surface, the bottom ends of the four support columns make contact with the seabed at the same time; when the seabed has an uneven surface, the bottom ends of some of the support columns first come into contact with the seabed, these support columns stop moving downwards, and rotation of the threaded sleeve is resisted, so that the first ring gear and the first gear stop rotating, and the friction wheel rotates relative to the first gear; and step 6, the rest of the support columns which are not in contact with the seabed continue to move downwards until the bottom ends of all the support columns are in contact with the seabed.

* * * * *